US008443897B2

(12) United States Patent
Zeller

(10) Patent No.: US 8,443,897 B2
(45) Date of Patent: May 21, 2013

(54) SUBSEA SAFETY SYSTEM HAVING A PROTECTIVE FRANGIBLE LINER AND METHOD OF OPERATING SAME

(75) Inventor: Vincent Paul Zeller, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/985,968

(22) Filed: Jan. 6, 2011

(65) Prior Publication Data

US 2012/0175126 A1 Jul. 12, 2012

(51) Int. Cl.
*E21B 7/12* (2006.01)

(52) U.S. Cl.
USPC ..... 166/363; 166/317; 166/344; 166/368

(58) Field of Classification Search
USPC ..... 166/363, 344, 368, 345, 367, 208, 166/242.1, 80.1, 332.8
See application file for complete search history.

(56) References Cited

U.S. PATENT DOCUMENTS 2,379,079 A * 6/1945 Hayward ..... 166/154
3,260,309 A * 7/1966 Brown ..... 166/124
3,786,866 A * 1/1974 Tausch et al. ..... 166/322
4,113,018 A * 9/1978 Barrington et al. ..... 166/324
4,371,045 A * 2/1983 McGuire et al. ..... 175/17
4,427,071 A * 1/1984 Carmody ..... 166/332.8
4,475,599 A * 10/1984 Akkerman ..... 166/323
4,542,792 A * 9/1985 Akkerman ..... 166/374
4,624,315 A * 11/1986 Dickson et al. ..... 166/323
4,683,943 A 8/1987 Hill et al.
4,723,606 A * 2/1988 Vinzant et al. ..... 166/319
4,813,481 A * 3/1989 Sproul et al. ..... 166/51
5,329,998 A 7/1994 King et al.
5,813,483 A * 9/1998 Latham et al. ..... 175/218
6,026,905 A 2/2000 Garcia-Soule
6,123,152 A * 9/2000 Edwards et al. ..... 166/377
6,241,013 B1 6/2001 Martin
6,311,775 B1 * 11/2001 Allamon et al. ..... 166/285
6,575,249 B2 * 6/2003 Deaton ..... 166/373
6,712,145 B2 * 3/2004 Allamon ..... 166/327
7,182,135 B2 2/2007 Szarka
7,287,596 B2 * 10/2007 Frazier et al. ..... 166/332.8
7,328,750 B2 2/2008 Swor et al.
7,650,945 B2 1/2010 Brown (Continued)

OTHER PUBLICATIONS

International Search Report and Written Opinion, PCT/US2011/065068, KIPO (Aug. 7, 2012).

*Primary Examiner* — Thomas Beach
*Assistant Examiner* — Aaron Lembo
(74) *Attorney, Agent, or Firm* — Lawrence R. Youst

(57) ABSTRACT

A subsea safety system (50) for use during a well treatment operation. The subsea safety system (50) includes a tubular string having an inner flow passage (112). At least one valve assembly (116, 134) is positioned within the tubular string. The valve assembly (116, 134) is operable between open and closed positioned to selectively permit and prevent fluid flow therethrough. A frangible liner (134) is disposed within the valve assembly (116, 134). The frangible liner (134) has a close fitting but not fluid tight relationship with the valve assembly (116, 134). The frangible liner (134) is operable to protect the valve assembly (116, 134) from particle flow during the well treatment operation. In addition, the frangible liner (134) is operable to shatter responsive to closure of the valve assembly (116, 134), thereby allowing full operation of the valve assembly (116, 134).

18 Claims, 9 Drawing Sheets

U.S. PATENT DOCUMENTS

| | | | | |
|---|---|---|---|---|
| 7,703,513 | B2 * | 4/2010 | Vinegar et al. | 166/245 |
| 7,810,567 | B2 | 10/2010 | Daniels et al. | |
| 2002/0000318 | A1 * | 1/2002 | Allamon et al. | 166/291 |
| 2003/0047315 | A1 * | 3/2003 | Allamon | 166/332.8 |
| 2004/0031622 | A1 * | 2/2004 | Butler et al. | 175/5 |
| 2004/0074635 | A1 * | 4/2004 | Collie et al. | 166/85.1 |
| 2006/0124315 | A1 * | 6/2006 | Frazier et al. | 166/369 |
| 2008/0105438 | A1 | 5/2008 | Jordan et al. | |
| 2009/0020290 | A1 | 1/2009 | Ross et al. | |
| 2009/0189617 | A1 * | 7/2009 | Burns et al. | 324/649 |

* cited by examiner

SUBSEA SAFETY SYSTEM HAVING A PROTECTIVE FRANGIBLE LINER AND METHOD OF OPERATING SAME

TECHNICAL FIELD OF THE INVENTION

This invention relates, in general, to equipment utilized in conjunction with operations performed in subterranean wells and, in particular, to a subsea safety system having a protective frangible liner and a method of operating same.

BACKGROUND OF THE INVENTION

Without limiting the scope of the present invention, its background will be described in relation to a safety system of a subsea well installation, as an example.

In certain subsea well installations, the safety systems may include a subsea safety tree on the lower end of a tubular string that may be positioned within the blowout preventer stack of a subsea wellhead. The subsea safety tree may include one or more shut-in valves that operate to automatically shut-in the well in the event of emergency conditions. In addition, the subsea safety tree may include a latch assembly that enables separation of the tubular string from the lower portion of the subsea safety tree, a retainer valve that prevents fluid discharge from the tubular string into the environment and a vent sleeve that provides for controlled venting of pressure trapped between the closed retainer valve and the closed shut-in valves of the subsea safety tree.

Conventionally, each of these components of the subsea safety tree, the retainer valve, the vent sleeve, the latch assembly and the shut-in valves, are controlled by fluid pressure in control lines which extend from a pressure source at the surface to the subsea safety tree. In many installations, dedicated control lines between each of the components and the surface are used, including both supply lines and return lines. In addition, the actuation of each of these components is controlled by electrical switches, such as solenoid valves, that selectively prevent and allow hydraulic pressure to operate the various components. In an emergency situation, the proper operation of these components is necessary to safely shut-in the well, contain fluid within the tubular string, bleed off pressure between the shut-in valves and the retainer valve and cause separation of the tubular string from the subsea well installation.

It has been found, however, that certain operations such as gravel packing, fracturing or fracture packing, that require proppant laden slurry to be pumped into the well through the tubular string, may result in damage to or debris buildup within components of the subsea safety tree. This damage or debris buildup may prevent proper operation of one or more of the components of the subsea safety tree. Accordingly, a need has arisen for systems and methods of protecting the components of the subsea safety tree during operations wherein proppant laden slurry is pumped into the well through a tubular string including a subsea safety tree.

SUMMARY OF THE INVENTION

The present invention disclosed herein is directed to systems and methods of using a frangible liner to protect components of a subsea safety tree during operations wherein proppant laden slurry is pumped into the well through a tubular string including the subsea safety tree. The systems and methods of the present invention utilize a frangible liner that may be preinstalled at the surface or shifted downhole into the subsea safety tree that provides a barrier between the components of the subsea safety tree and the proppant laden slurry during treatment operations but is easily shattered or otherwise disintegrates to allow proper operation of the components of the subsea safety tree during, for example, a shut-in of the well due to emergency conditions.

In one aspect, the present invention is directed to a subsea safety system for use during a well treatment operation. The subsea safety system includes a tubular string having an inner flow passage. At least one valve assembly is positioned within the tubular string. The at least one valve assembly is operable between open and closed positions to selectively permit and prevent fluid flow therethrough. A frangible liner is disposed within the at least one valve assembly. The frangible liner is operable to protect the at least one valve assembly from particle flow during the well treatment operation and is operable to shatter responsive to closure of the at least one valve assembly, thereby allowing full operation of the at least one valve assembly.

In one embodiment, the at least one valve assembly may be a safety valve. In another embodiment, the at least one valve assembly may be a flapper valve. In a further embodiment, the at least one valve assembly may be a ball valve. In yet another embodiment, the at least one valve assembly may include at least two valve assemblies.

In one embodiment, the frangible liner may have a smooth inner surface. In another embodiment, the frangible liner may have at least one tapered end. In a further embodiment, the frangible liner may be a retractable frangible liner. In certain embodiment, the frangible liner may be formed from a material selected from the group consisting of ceramics, fiberglass, epoxies, graphic epoxy, glass ceramics and polymers. In some embodiments, the frangible liner may have a close fitting but not fluid tight relationship with the at least one valve assembly.

In another aspect, the present invention is directed to a subsea safety system for use during a well treatment operation. The subsea safety system includes a tubular string having an inner flow passage. At least one valve assembly is positioned within the tubular string. The at least one valve assembly is operable between open and closed positions to selectively permit and prevent fluid flow therethrough. A frangible liner is disposed within the at least one valve assembly. The frangible liner has a close fitting but not fluid tight relationship with the at least one valve assembly. The frangible liner is operable to protect the at least one valve assembly from particle flow during the well treatment operation and is operable to shatter responsive to closure of the at least one valve assembly, thereby allowing full operation of the at least one valve assembly.

In a further aspect, the present invention is directed to a method of operating a subsea safety system. The method includes positioning at least one valve assembly within a tubular string having an inner flow passage, disposing a frangible liner within the at least one valve assembly, pumping a treatment fluid through the inner flow passage of the tubular string, protecting the at least one valve assembly from particles in the treatment fluid with the frangible liner, operating the at least one valve assembly from an open position to a closed position to prevent fluid flow therethrough and shattering the frangible liner in response to the closing of the at least one valve assembly, thereby allowing full operation of the at least one valve assembly.

The method may also include operating a flapper valve from an open position to a closed position, operating a ball valve from an open position to a closed position or establishing a close fitting but not fluid tight relationship between the frangible liner and the at least one valve assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
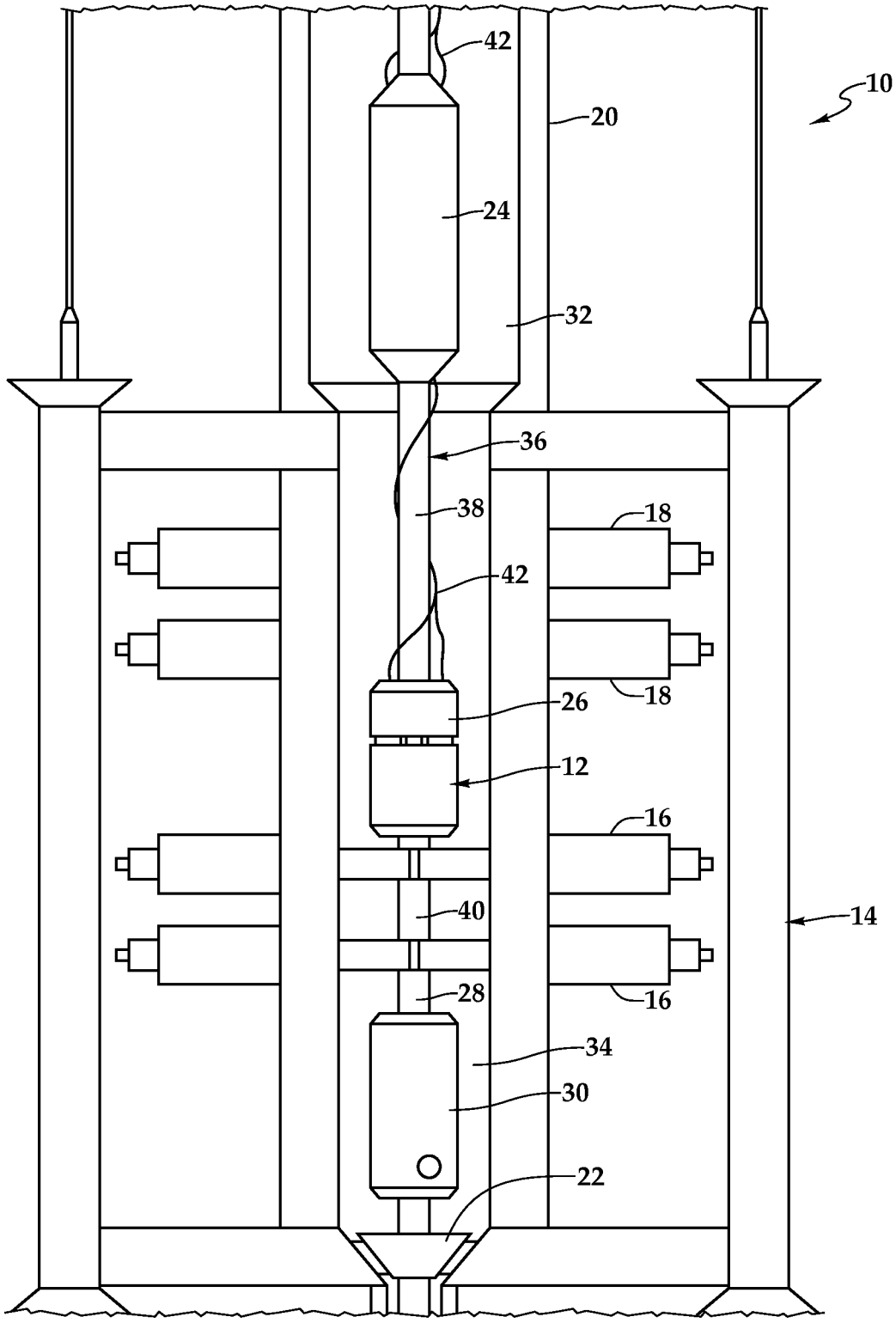
FIG. 1 is a schematic illustration of a subsea well installation including a subsea safety system having a protective frangible liner according to an embodiment of the present invention.

Referring to FIG. 1, a subsea well installation including a subsea safety system having a protective frangible liner is schematically illustrated and generally designated 10. In the following description, directional terms, such as above, below, upper, lower and the like are used for convenience in referring to the accompanying drawings and it is to be clearly understood that the various embodiments of the present invention described herein may be utilized in various orientations, such as inclined, inverted, horizontal, vertical and the like, without departing from the principles of the present invention.

Subsea well installation 10 includes a subsea test tree 12 that is positioned within a blowout preventer (BOP) stack 14 installed on the ocean floor. BOP stack 14 includes two pipe rams 16 and two shear rams 18 that are configured and controlled according to conventional practice. In the illustrated embodiment, BOP stack 14 is a compact BOP stack having multiple pipe and shear rams 16, 18, but it is to be clearly understood that the present invention may be utilized in other types of BOP stacks and in BOP stacks having greater or fewer numbers of pipe and shear rams.

Subsea test tree 12 has been lowered into BOP stack 14 through a tubular riser 20 extending upwardly therefrom. A fluted wedge 22 attached below subsea test tree 12 permits accurate positioned of subsea test tree 12 within BOP stack 14. In the illustrated embodiment, a retainer valve 24 is attached above subsea test tree 12 and remains within riser 20 when subsea test tree 12 is positioned within BOP stack 14.

Subsea test tree 12 includes a latch head assembly 26, a ramlock assembly 28 and a valve assembly 30. Ramlock assembly 28 is interconnected axially between latch head assembly 26 and valve assembly 30 to axially separate these components from one another. As used herein, the term ramlock assembly is used to indicate one or more members which are configured in such a way as to permit sealing engagement with conventional pipe rams. For example, as shown in FIG. 1, ramlock assembly 28 is shown in sealing engagement with both of the pipe rams 16 as pipe rams 16 have been previously actuated to extend inwardly to engage ramlock assembly 28. As illustrated, latch head assembly 26 and valve assembly 30 have diameters which are greater than that which may be sealingly engaged by conventional pipe rams, therefore, ramlock assembly 28 provides for sealing engagement of the pipe rams 16 between latch head assembly 26 and valve assembly 30.

Valve assembly 30 is positioned between pipe rams and wedge 22 such that when pipe rams 16 are closed about ramlock assembly 28, valve assembly 30 is isolated from an annulus 32 above pipe rams 16. Pipe rams 16 isolate annulus 32 from an annulus 34 below pipe rams 16 and surrounding valve assembly 30. As used herein, the term valve assembly is used to indicate an assembly including one or more valves which are operative to selectively permit and prevent fluid flow through a flow passage formed through the valve assembly. For example, valve assembly 30 of FIG. 1 includes two safety valves (not visible), which are operative to control fluid flow through a tubular string 36. Retainer valve 24, latch head assembly 26, ramlock assembly 28 and valve assembly 30 are all interconnected within and are part of tubular string 36. Tubular string 36 has a flow passage formed therethrough and the valves in valve assembly 30 may be actuated to permit or prevent fluid flow therethrough. Even though valve assembly 30 has been described as having two safety valves, it is to be clearly understood by those skilled in the art that it is not necessary for valve assembly 30 to include multiple valves, or for the valves to be safety valves, in keeping with the principles of the present invention.

As used herein, the term latch head assembly is used to indicate one or more members which permit decoupling of one portion of tubular string 36 from another portion thereof. For example, in the representatively illustrated subsea test tree 12, latch head assembly 26 may be actuated to decouple an upper portion 38 of tubular string 36 from a lower portion 40 of tubular string 36. Thus, in the event of an emergency, pipe rams 16 may be closed on ramlock assembly 28, the valves in valve assembly 30 may be closed, and upper portion 38 of tubular string 36 may be retrieved, or otherwise displaced away from lower portion 40. Closure of pipe rams 16 on ramlock assembly 28 and closure of the valves in valve assembly 30 isolates the well therebelow from fluid communication with riser 20.

If desired, shear rams 18 may be actuated to shear upper portion 38 of tubular string 36 above latch head assembly 26. Upper portion 38 may be sheared at a tubular handling sub attached above latch head assembly 26. For this reason, latch head assembly 26 is positioned between shear rams 18 and pipe rams 16. In this manner, redundancy is preserved and safety is, therefore, enhanced in that two shear rams 18 are usable above latch head assembly 26 and two pipe rams 16 are usable below latch head assembly 26 in the compact BOP stack 14.

Actuation of retainer valve 24, latch head assembly 26 and valve assembly 30 is controlled via lines 42. In the representatively illustrated embodiment shown in FIG. 1, lines 42 are hydraulic lines which extend to the earth's surface and are used for delivering pressurized fluid to subsea test tree 12 and retainer valve 24. Those skill in the art, however, will understand that lines 42 could alternatively be one or more electrical lines and that subsea test tree 12 and/or retainer valve 24 could be electrically actuated, the lines could be replaced by one or more telemetry devices, the lines could extend to other locations in the well or the like without departing from the principles of the present invention.

Positioned within tubular string 36 and specifically within latch head assembly 26 and valve assembly 30 is a frangible liner (not visible in FIG. 1). As explained in greater detail below, the frangible liner is designed to prevent particles such as sand, gravel or proppants in a treatment fluid, from damaging or buildup within latch head assembly 26 and valve assembly 30 but to shatter in response to the closure of the valves within valve assembly 30, thereby allowing full operation of the valves within valve assembly 30. Preferably, the frangible liner has a smooth inner surface, is relatively thin walled and has tapered ends to minimize its effects on the flow of treatment fluid therethrough. The frangible liner may be formed from a frangible material such as ceramics, fiberglass, epoxies, graphic epoxy, glass ceramics or polymers. Preferably, the frangible liner has a close fitting but not fluid tight relationship with tubular string 36 such that the frangible liner will not have to withstand the pressure within tubular string 36.

Referring additionally now to FIGS. 2A-2D, a subsea test tree, such as subsea test tree 12 described in FIG. 1, which embodies principles of the present invention is representatively illustrated and generally designated 50. Subsea test tree 50 includes a valve assembly 52 and a latch head assembly 54. At an upper end of latch head assembly 54, an upper sub 56 is threadedly and sealingly installed therein. Upper sub 56 may be provided with additional threads and seals at an upper end thereof in a conventional manner for interconnection of subsea test tree 50 within a tubular string, such as tubular string 36 of FIG. 1. Similarly, at a lower end of valve assembly 52, a lower sub 58 is threadedly and sealingly installed therein. Lower sub 58 is also provided with threads and a seal for interconnection of subsea test tree 50 within a tubular string, such as tubular string 36 of FIG. 1. Thus, subsea test tree 50 may be interconnected in the tubular string 36 as parts of the upper and lower portions 38, 40 thereof, in a manner similar to that in which subsea test tree 12 is interconnected in FIG. 1. However, it is to be clearly understood that subsea test tree 50 may be otherwise interconnected in a tubular string and may be utilized in other configurations, without departing from the principles of the present invention.

Figure 2A:
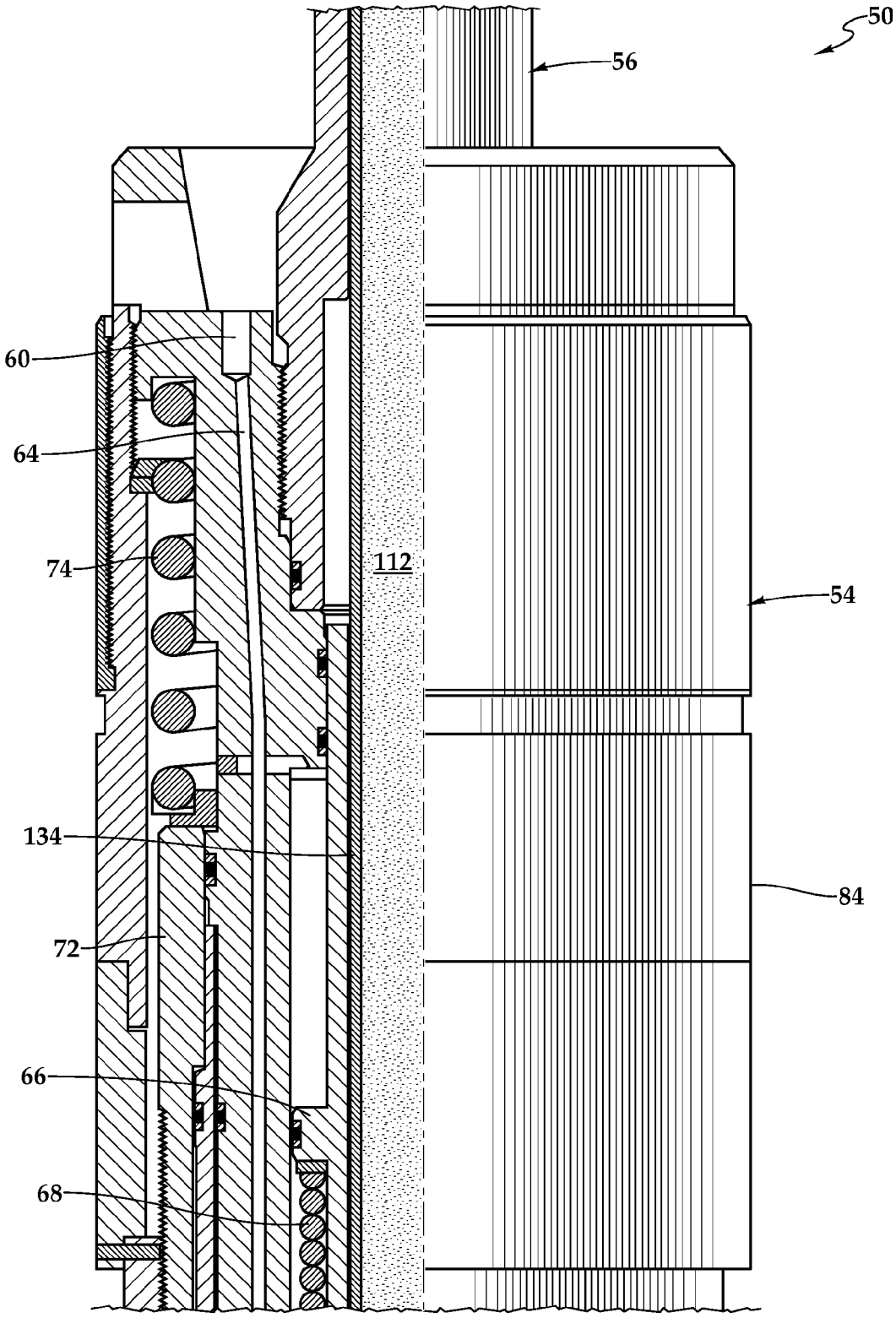
FIGS. 2A-2D are quarter sectional views of consecutive axial sections of a subsea safety system in an open configuration having a protective frangible liner according to an embodiment of the present invention.

Lines, such as lines 42 shown in FIG. 1, may be connected to subsea test tree 50 at ports 60, only one such port being visible in FIG. 2A, but it is to be understood that other ports are provided. In the illustrated embodiment, port 60 is for connection of a control line and other ports are for connection of a balance line, connection of a latch line, connection of an injection line or alternate control lines for operation of subsea test tree 50. Of course, other ports, lines, and other numbers and combinations of lines and ports may be utilized without departing from the principles of the present invention.

From port 60, a control line passage 64 is formed in latch head assembly 54 and extends downwardly therethrough. Control line passage 64 is in fluid communication with an annular piston 66 that is axially reciprocably and sealingly received within latch head assembly 54. Fluid pressure in control line passage 64 acts to bias piston 66 downward against an upwardly biasing force exerted by a bias member or spring 68 as well as fluid pressure from the balance line (not pictured) that acts to bias piston 66 upward. In operation, fluid in the balance line is used to balance hydrostatic pressure in control line passage 64 and pressure may be applied to the balance line passage if desired to aid spring 68 in shifting piston 66 upward.

Another piston 72 is axially reciprocably and sealingly disposed within latch head assembly 54. Piston 72 is biased downwardly by a bias member or spring 74. At a lower end of piston 72, an outer tapered surface 76 is formed and is utilized to outwardly retain a set of lugs or dogs 78 in engagement with an annular profile 80 formed internally on a portion of an outer housing 82 of latch head assembly 54. Of course, other surfaces and otherwise-shaped surfaces may be used to maintain engagement of lugs 78 in profile 80.

Figure 2B:
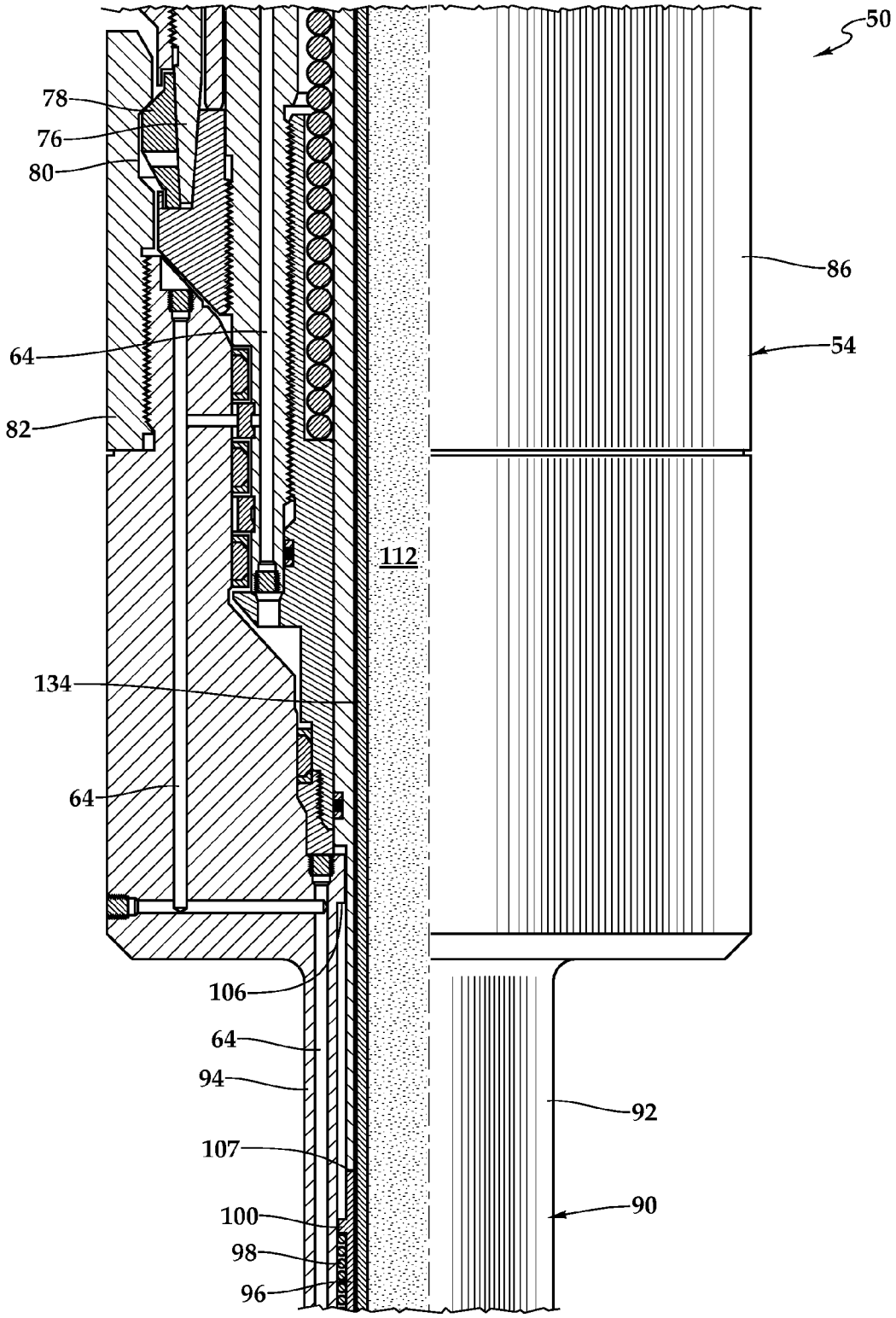
Figure 2C:
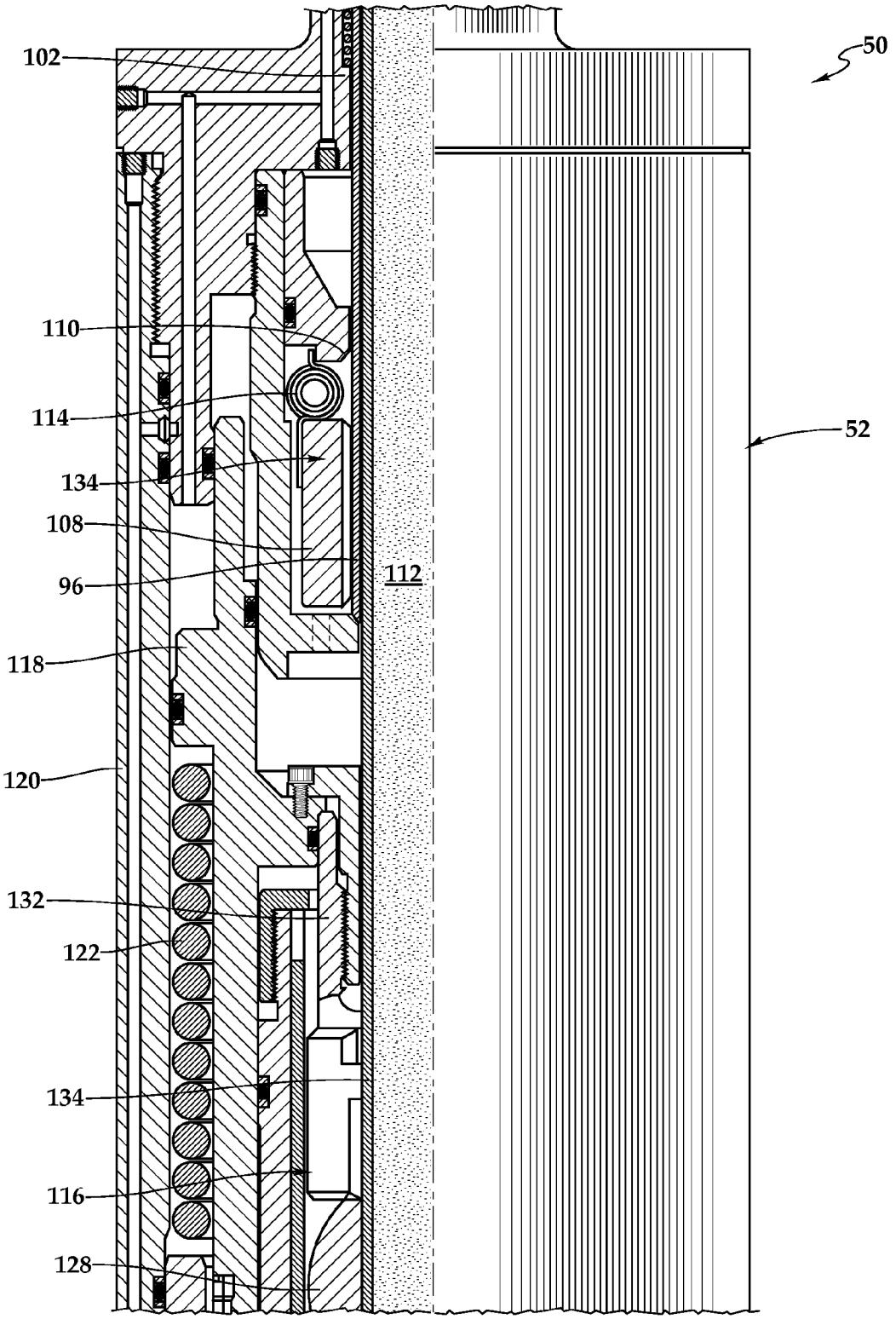

It will be readily appreciated that, with piston 72 in its downwardly disposed position as shown in FIGS. 2A-2B, lugs 78 are outwardly supported by surface 76, but when piston 72 is in an upwardly disposed position, lugs 78 are not outwardly supported and may be disengaged from profile 80. Thus, with piston 72 in its downwardly disposed position, latch head assembly 54 is latched, and with piston 72 in its upwardly disposed position, latch head assembly 54 is unlatched. When latch head assembly 54 is unlatched, an upper portion 84 thereof may be upwardly displaced relative to a lower portion 86 thereof. When latch head assembly 54 is latched, such axial separation is prevented.

A ramlock assembly 90 is interconnected between latch head assembly 54 and valve assembly 52. Ramlock assembly 90 axially separates latch head assembly 54 from valve assembly 52 and provides an appropriately sized and configured outer side surface 92, which may be sealingly engaged by a conventional pipe ram. The depicted outer side surface 92 is generally cylindrical in shape, but it is to be understood that otherwise-shaped surfaces may be utilized without departing from the principles of the present invention.

In the illustrated embodiment, an upper end of ramlock assembly 90 is integrally formed with, and forms a part of, lower portion 86 of latch head assembly 54. A lower end of ramlock assembly 90 is integrally formed with, and forms a part of, valve assembly 52. However, it is to be clearly understood that ramlock assembly 90 may be separately formed and otherwise attached between valve assembly 52 and latch head assembly 54, without departing from the principles of the present invention. Ramlock assembly 90 includes an outer tubular member 94, which has outer surface 92 formed thereon and an inner tubular member 96. Inner tubular member 96 is axially reciprocably disposed within outer tubular member 94 and is biased upwardly by a bias member or spring 98. Spring 98 is disposed radially between inner and outer tubular members 96, 94. Control line passage 64 extends downwardly through a sidewall of outer member 94. In this manner, fluid pressure in control line 64 is available for use in valve assembly 52, as is described in more detail below.

Spring 98 is axially compressed between a radially enlarged shoulder 100 formed externally on the inner member 96 and a shoulder 102 formed internally on outer member 94 within valve assembly 52. Of course, spring 98 could easily be otherwise positioned. When inner member 96 is in its upwardly disposed position, it abuts a shoulder 106 internally formed on outer member 94 within latch head assembly 54. Inner member 96 also abuts a lower end of piston 66 at location 107. As piston 66 is displaced between its upwardly and downwardly disposed positions, inner member 96 is thereby correspondingly displaced between its upwardly and downwardly disposed positions. Spring 98 maintains engagement between piston 66 and inner member 96 between the upwardly and downwardly disposed positions and ensures that when piston 66 is displaced upwardly, inner member 96 also displaces upwardly therewith. However, note that the engagement between piston 66 and inner member 96 is releasable. When latch head assembly 54 is unlatched, piston 66 may be displaced upwardly with the remainder of upper portion 84 away from lower portion 86. Thus, piston 66 and inner member 96 may be axially separated.

As illustrated, when inner member 96 is displaced downwardly by piston 66 in response to fluid pressure in control line passage 64, a lower end of inner member 96 contacts and pivots a generally disc-shaped flapper 108 away from a circumferential seat 110. When inner member 96 is in its upwardly disposed position, flapper 108 is permitted to sealingly engage seat 110, thereby preventing fluid flow through inner flow passage 112 formed axially through subsea test tree 50. A bias member or spring 114 biases flapper 108 toward its closed position. Flapper 108, seat 110, spring 114 and the lower end of inner member together constitute a flapper valve 134 in valve assembly 52. Flapper valve 134 is in many respects similar to flapper valves well known to those skilled in the art and utilized in conventional safety valves. In addition, valve assembly 52 also includes a second safety valve depicted as ball valve 116. Thus, valve assembly 52 has two valves disposed therein, each of the valves being safety valves. It is, however, to be understood that other numbers of valves and other types of valves may be disposed within valve assembly 52 in keeping with the principles of the present invention.

Ball valve 116 includes an annular piston 118 axially reciprocably and sealingly disposed within outer housing 120 of valve assembly 52. Piston 118 is upwardly biased by a bias member or spring 122 and by a pressurized gas chamber 124 that preferably contains a pressurized gas such as nitrogen, that exerts an upwardly biasing force on an annular floating piston 126 which, in turn, transmits the upwardly directed force to a lower end of piston 118. To downwardly displace piston 118, fluid pressure is applied to control line passage 64, which is in fluid communication with piston 118. When piston 118 is in its downwardly displaced position, a ball 128 of ball valve 116 has an opening aligned with flow passage 112, permitting fluid flow therethrough. When piston 118 is in its upwardly displaced position, ball 128 is in its closed position, with flow through the opening being prevented.

Axial displacement of piston 118 is translated into rotation of ball 128 by an actuator mechanism 132 of the type well known to those skilled in the art. Actuator mechanism 132 may be similar to those used in conventional ball valves. However, it is to be understood that other actuator mechanisms and other types of actuators may be used, without departing from the principles of the present invention. When it is desired to open ball valve 116, sufficient fluid pressure is applied to control line passage 64 to displace piston 118 downward against the combined upwardly biasing forces due to fluid pressure in the balance line, spring 122 and the compressed gas in chamber 124. When it is desired to close ball valve 116, fluid pressure is released from control line passage 64, permitting piston 118 to displace upwardly. If desired, fluid pressure may be applied to the balance line to assist in displacing piston 118 upwardly.

Positioned within subsea test tree 50 and extending through latch head assembly 54 and valve assembly 52 is a frangible liner 134. Frangible liner 134 provides a protective layer between moving particles, such as sand, gravel or proppants in a treatment fluid, and the shoulders and moving components of subsea test tree 50 to prevent erosive and other damage to these components and well as to prevent buildup of these particles within subsea test tree during the treatment operation. In the illustrated embodiment, frangible liner 134 is depicted as being formed as a single liner extending from upper sub 56 to lower sub 58, however, those skilled in the art will recognize that frangible liner 134 could be formed in multiple sections that are coupled or interconnected together or in multiple sections that are not coupled or interconnected together so long as the critical components of subsea test tree 50 are protected.

In certain embodiments, frangible liner 134 may be installed within subsea test tree 50 at the surface prior to lowering subsea test tree 50 into BOP stack 14. Alternatively, frangible liner 134 may be positioned within a section of the tubular string above subsea test tree 50 and shifted into the illustrated position prior to a treatment operation. In either embodiment, if desired, frangible liner 134 may be retracted out of subsea test tree 50 into the section of the tubular string above subsea test tree 50 after the treatment operation. As another alternative, if desired, frangible liner 134 may be shattered, disintegrated into small fragments or pieces or otherwise removed from subsea test tree 50 by mechanical, acoustic or explosive means or through the use of a chemical process after the treatment operation.

Figure 2D:
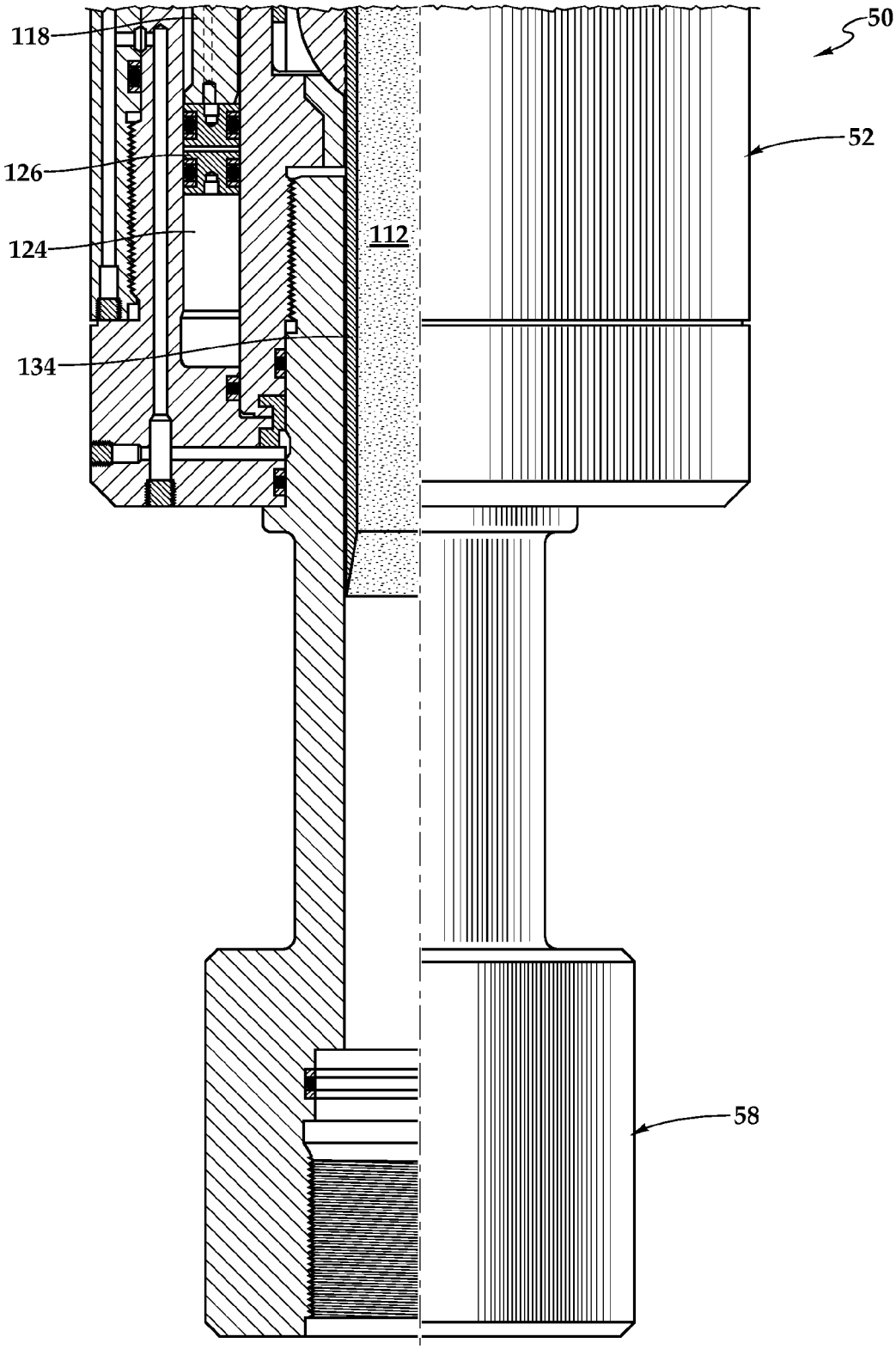
Figure 3A:
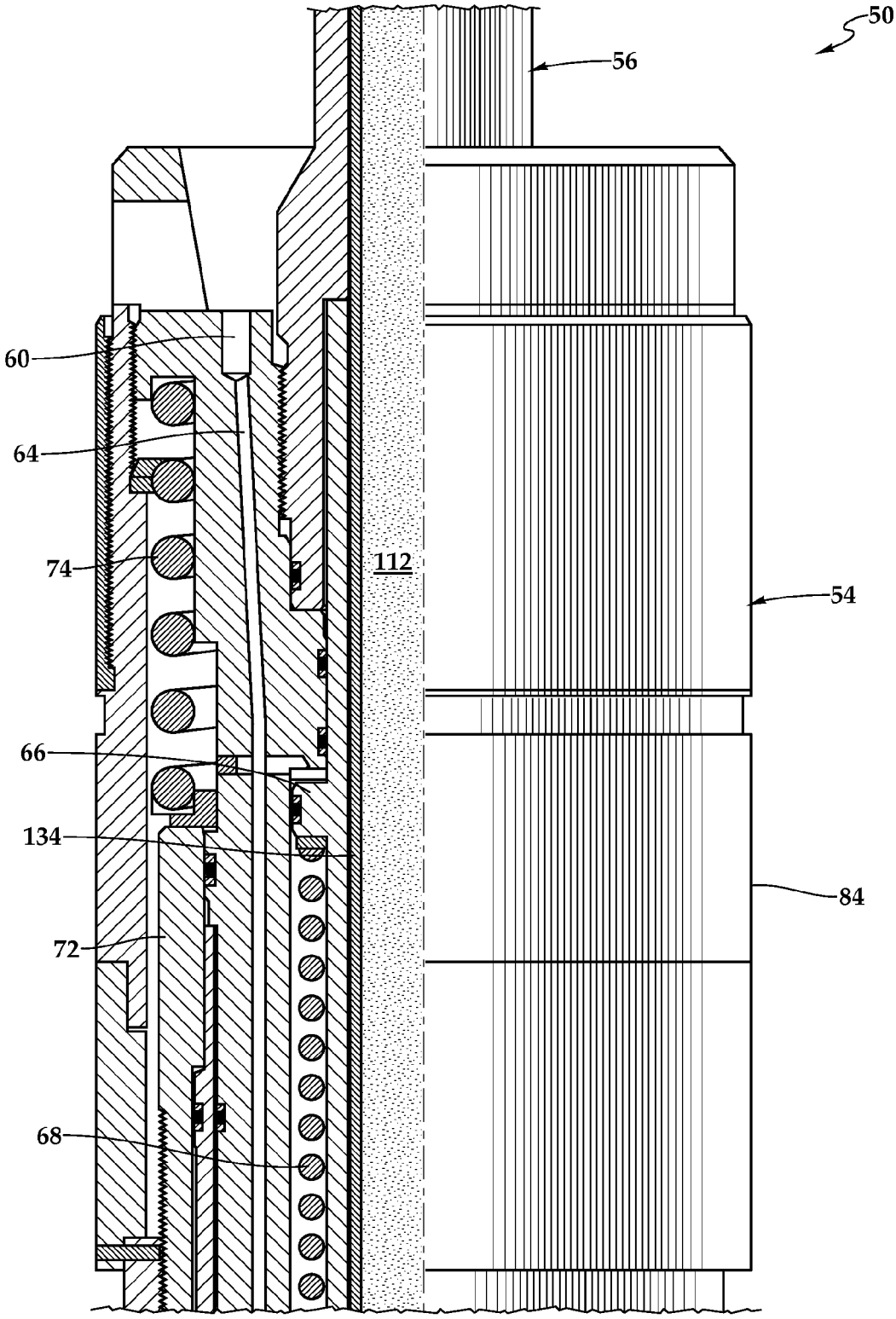
FIGS. 3A-3D are quarter sectional views of consecutive axial sections of a subsea safety system in a closed configuration having a partially shattered frangible liner according to an embodiment of the present invention.
Figure 3B:
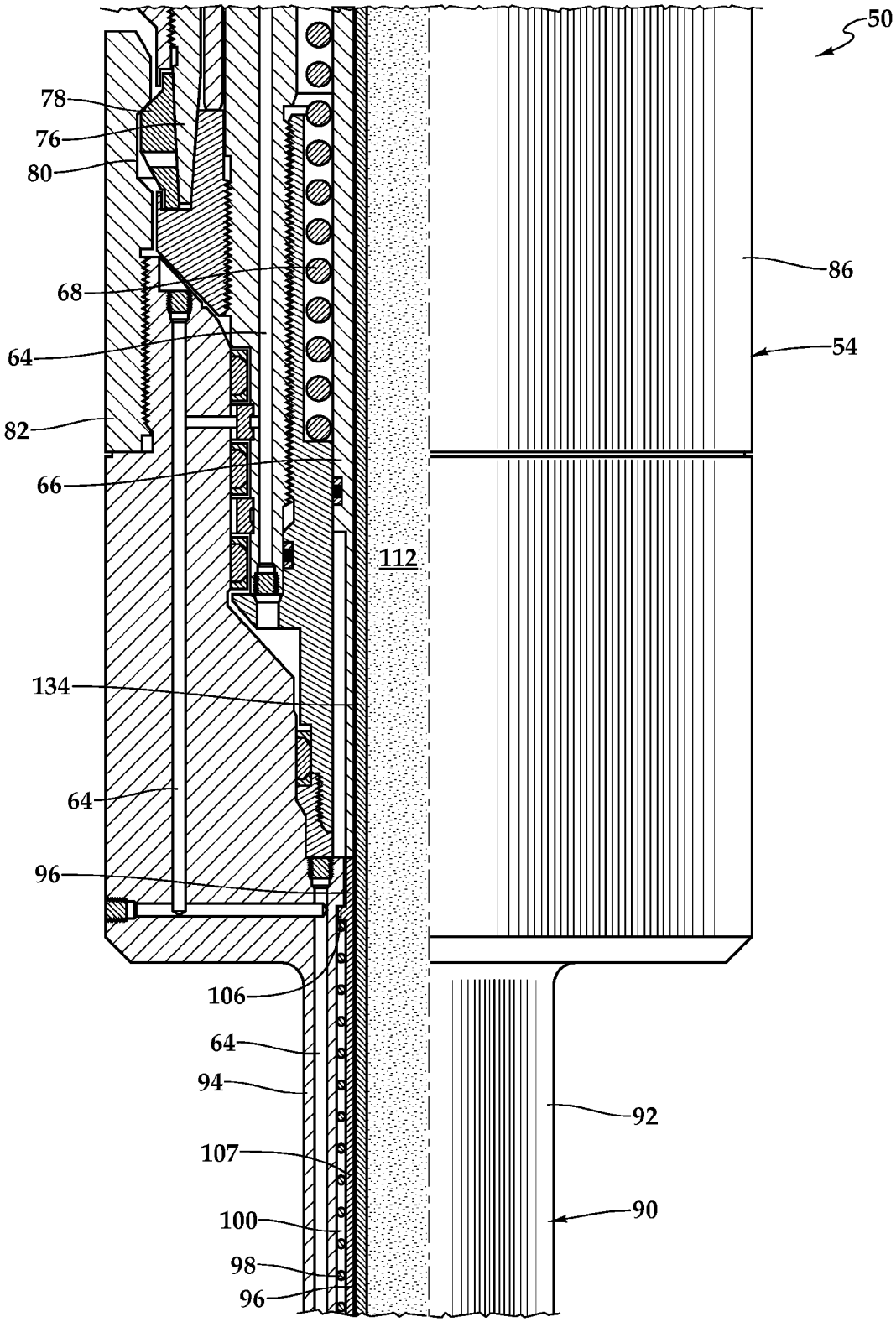
Figure 3C:
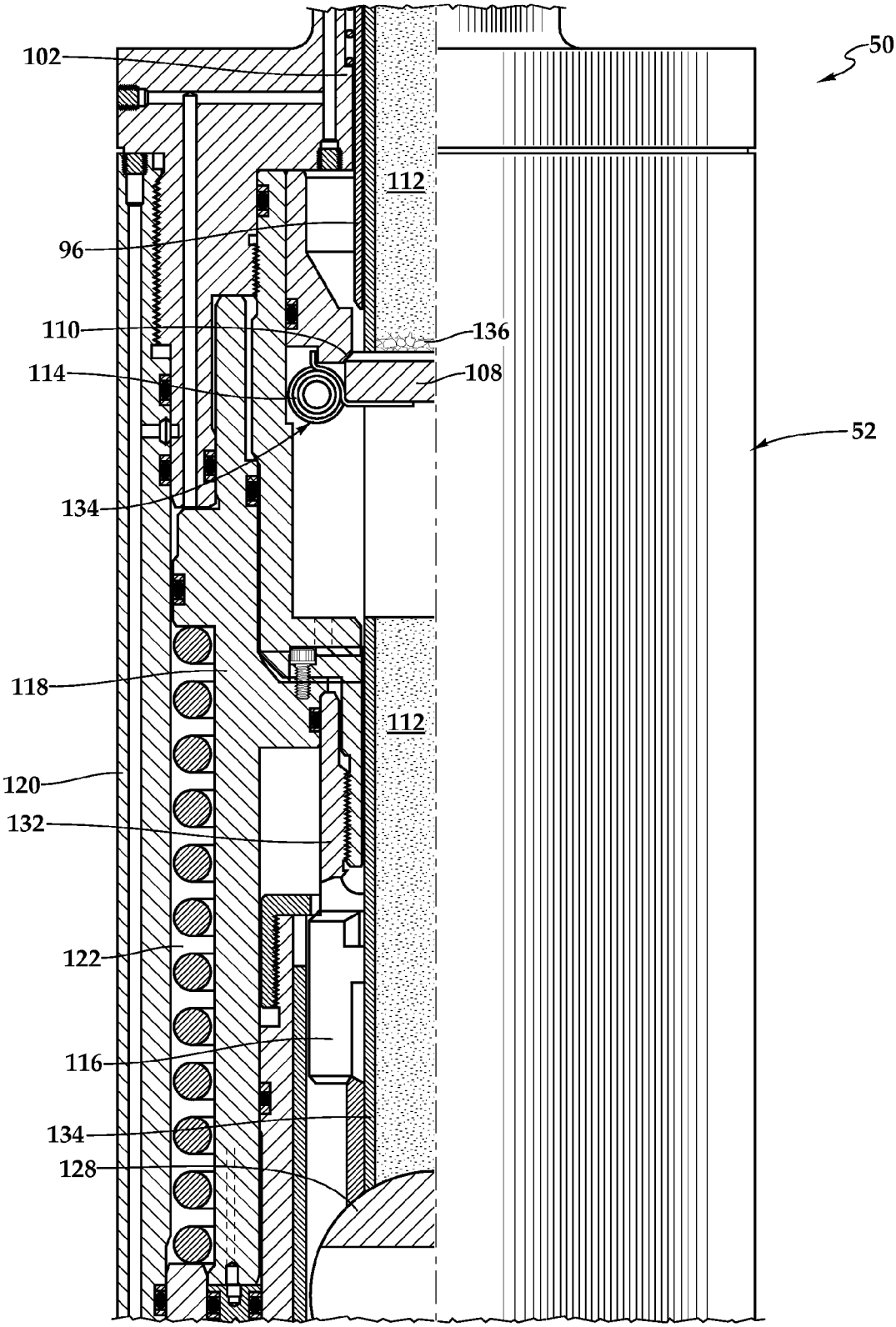
Figure 3D:
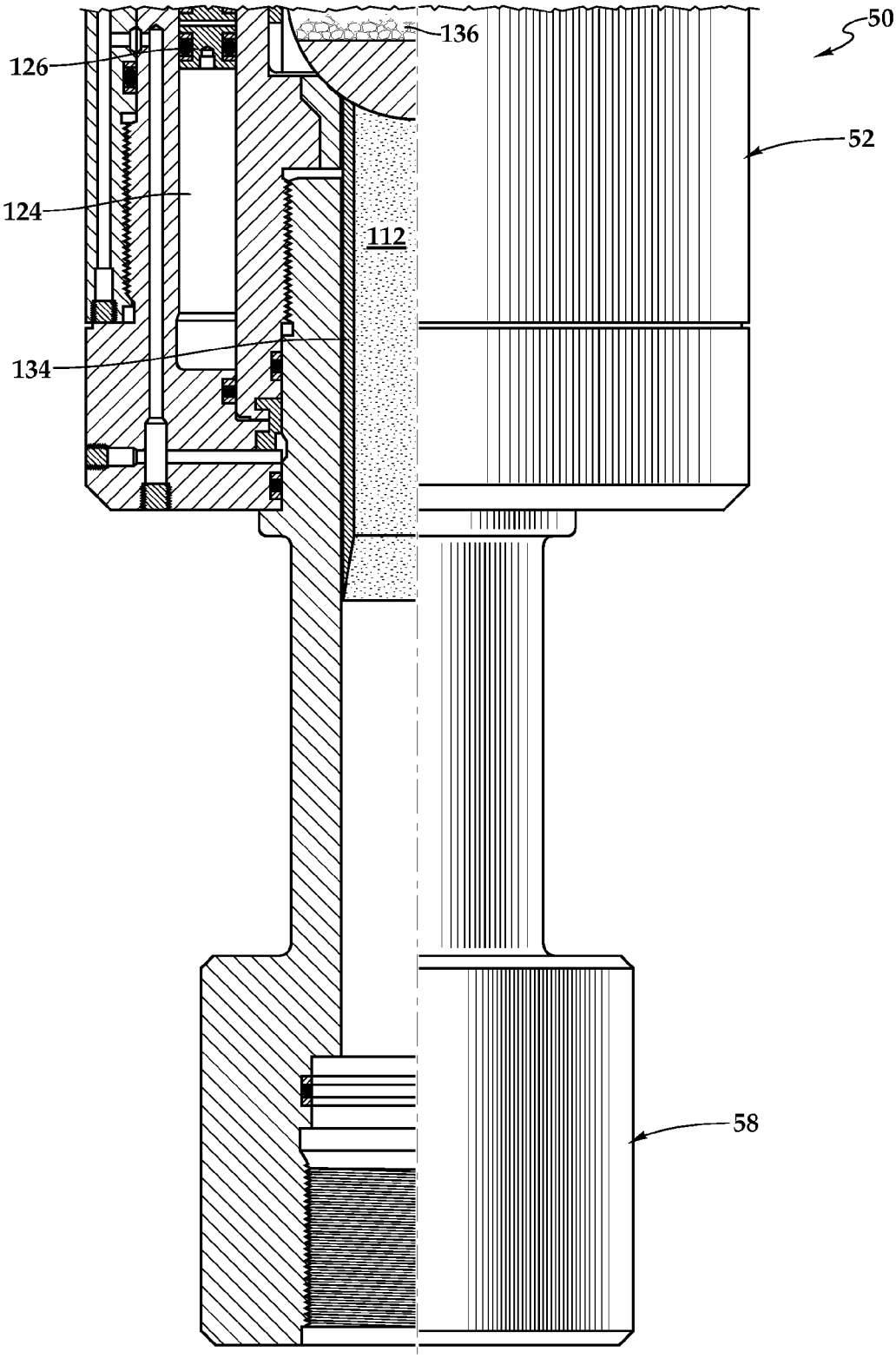

Frangible liner 134 is formed from a thin walled tubular, preferably having a wall thickness of between about 50 and 100 thousandth of an inch and more preferably between about 60 and 70 thousandth of an inch. Frangible liner 134 may be constructed from any material that is suitable for its intended purpose including, but not limited to, ceramics, fiberglass, epoxies, graphic epoxy, glass ceramics and polymers, any of which may be chemically treated to enhance the desired properties. Frangible liner 134 preferably has a smooth inner surface and, as best seen in FIG. 2D, tapered ends to minimize its effects on the flow of a treatment fluid therethrough. Preferably, the tapered ends have a shallow angle such as between about 5 and 20 degrees and more preferably between about 8 and 12 degrees. In order to maintain a desired bore size, frangible liner 134 preferably has a close fitting relationship with the inner surfaces of subsea test tree 50. In addition, due to its material properties and wall thickness, frangible liner 134 preferably does not have a fluid tight sealing relationship with the inner surfaces of subsea test tree 50 such that frangible liner 134 will not have to withstand the pressure within subsea test tree 50.

Importantly, frangible liner 134 is designed and constructed such that it shatters in response to the closure of flapper valve 134 and/or ball valve 116 of valve assembly 52 in the event of an emergency condition or other event requiring closure of one or more of the valves in valve assembly 52, as best seen in FIGS. 3A-3D. The material of frangible liner 134 will shatters into numerous pieces in response to the inwardly radially directed impact and forces applied thereto by the closure of valves such as flapper valve 134 and ball valve 116. Upon shattering, the fragments 136 of frangible liner 134 are sufficiently small such that full and proper operation of flapper valve 134 and ball valve 116 is accomplished following the shattering process.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A subsea safety system for use during a well treatment operation, the subsea safety system comprising:

a tubular string having an inner flow passage;

at least one valve assembly positioned within the tubular string, the at least one valve assembly operable between open and closed positions to selectively permit and prevent fluid flow therethrough; and a frangible liner disposed within the at least one valve assembly, the frangible liner operable to protect the at least one valve assembly from particle flow during the well treatment operation and operable to shatter responsive to closure of the at least one valve assembly, thereby allowing full operation of the at least one valve assembly.

2. The subsea safety system as recited in claim 1 wherein the at least one valve assembly further comprises a safety valve.

3. The subsea safety system as recited in claim 1 wherein the at least one valve assembly further comprises a flapper valve.

4. The subsea safety system as recited in claim 1 wherein the at least one valve assembly further comprises a ball valve.

5. The subsea safety system as recited in claim 1 wherein the at least one valve assembly further comprises at least two valve assemblies.

6. The subsea safety system as recited in claim 1 wherein the frangible liner further comprises a smooth inner surface.

7. The subsea safety system as recited in claim 1 wherein the frangible liner further comprises at least one tapered end.

8. The subsea safety system as recited in claim 1 wherein the frangible liner further comprises a material selected from the group consisting of ceramics, fiberglass, epoxies, graphic epoxy, glass ceramics and polymers.

9. The subsea safety system as recited in claim 1 wherein the frangible liner has a close fitting relationship with the at least one valve assembly.

10. A subsea safety system for use during a well treatment operation, the subsea safety system comprising:

a tubular string having an inner flow passage;

at least one valve assembly positioned within the tubular string, the at least one valve assembly operable between open and closed positions to selectively permit and prevent fluid flow therethrough; and a frangible liner disposed within the at least one valve assembly, the frangible liner having a close fitting relationship with the at least one valve assembly, the frangible liner operable to protect the at least one valve assembly from particle flow during the well treatment operation and operable to shatter responsive to closure of the at least one valve assembly, thereby allowing full operation of the at least one valve assembly.

11. The subsea safety system as recited in claim 10 wherein the at least one valve assembly is selected from the group consisting of safety valves, flapper valves and ball valves.

12. The subsea safety system as recited in claim 10 wherein the frangible liner further comprises a smooth inner surface.

13. The subsea safety system as recited in claim 10 wherein the frangible liner further comprises at least one tapered end.

14. The subsea safety system as recited in claim 10 wherein the frangible liner further comprises a material selected from the group consisting of ceramics, fiberglass, epoxies, graphic epoxy, glass ceramics and polymers.

15. A method of operating a subsea safety system comprising:

positioning at least one valve assembly within a tubular string having an inner flow passage;

disposing a frangible liner within the at least one valve assembly;

pumping a treatment fluid through the inner flow passage of the tubular string;

protecting the at least one valve assembly from particles in the treatment fluid with the frangible liner;

operating the at least one valve assembly from an open position to a closed position to prevent fluid flow therethrough; and shattering the frangible liner in response to the closing of the at least one valve assembly, thereby allowing full operation of the at least one valve assembly.

16. The method as recited in claim 15 wherein operating the at least one valve assembly from an open position to a closed position further comprises operating a flapper valve from an open position to a closed position.

17. The method as recited in claim 15 wherein operating the at least one valve assembly from an open position to a closed position further comprises operating a ball valve from an open position to a closed position.

18. The method as recited in claim 15 further comprising establishing a close fitting relationship between the frangible liner and the at least one valve assembly.

* * * * *